US010731578B2

(12) United States Patent
Hatano

(10) Patent No.: US 10,731,578 B2
(45) Date of Patent: Aug. 4, 2020

(54) EVAPORATED FUEL PROCESSING DEVICE

(71) Applicant: AISAN KOGYO KABUSHIKI KAISHA, Obu-shi, Aichi (JP)

(72) Inventor: Makoto Hatano, Nagoya (JP)

(73) Assignee: AISAN KOGYO KABUSHIKI KAISHA, Obu-Shi, Aichi (JP)

( * ) Notice: Subject to any disclaimer, the term of this patent is extended or adjusted under 35 U.S.C. 154(b) by 0 days.

(21) Appl. No.: 16/360,451

(22) Filed: Mar. 21, 2019

(65) Prior Publication Data

US 2019/0301381 A1 Oct. 3, 2019

(30) Foreign Application Priority Data

Mar. 28, 2018 (JP) ..... 2018-062458

(51) Int. Cl.
*F02D 41/24* (2006.01)
*F02D 41/00* (2006.01)
*F02M 25/08* (2006.01)

(52) U.S. Cl.
CPC ..... *F02D 41/0045* (2013.01); *F02M 25/089* (2013.01); *F02M 25/0836* (2013.01); *F02M 2025/0845* (2013.01)

(58) Field of Classification Search
CPC ..... F02D 41/0045; F02D 41/2451; F02D 41/2432; F02D 2200/0414; F02M 25/089; F02M 25/0836; F02M 25/08; F02M 2025/0845
USPC ..... 123/516, 518, 519, 520; 701/103–105, 701/107; 73/114.39
See application file for complete search history.

(56) References Cited

U.S. PATENT DOCUMENTS 10,557,441 B2 * 2/2020 Kato ..... F02D 41/0045

FOREIGN PATENT DOCUMENTS

JP 2017180320 A 10/2017

* cited by examiner

*Primary Examiner* — Hai H Huynh
(74) *Attorney, Agent, or Firm* — Shumaker, Loop & Kendrick, LLP

(57) ABSTRACT

An evaporated fuel processing device may include a canister retaining evaporated fuel in a fuel tank, a vent passage communicating the canister and an intake passage of an engine, a first pump that discharges mixed gas of air and the evaporated fuel to the intake passage via the vent passage, a detector that detects a first pressure value indicating a pressure of the mixed gas discharged by the first pump, a memory storing pressure value-concentration correlated data indicating mixed gas, an acquisition unit that acquires a third pressure value indicating an air pressure detected by the detector in a case where the air containing substantially no evaporated fuel is discharged by the first pump, and an estimation unit that estimates a concentration of the evaporated fuel contained in the mixed gas discharged by the first pump by using the first and third pressure values and the pressure value-concentration correlated data.

3 Claims, 12 Drawing Sheets

EVAPORATED FUEL PROCESSING DEVICE

CROSS-REFERENCE

This application claims priority to Japanese Patent Application No. 2018-062458, filed on Mar. 28, 2018, the entire contents of which are incorporated herein by reference.

TECHNICAL FIELD

The disclosure herewith relates to an evaporated fuel processing device.

BACKGROUND

Japanese Patent Application Publication No. 2017-180320 describes an evaporated fuel processing device. The evaporated fuel processing device comprises a canister, a vent passage, a pump, and a detector. The canister retains evaporated fuel generated in a fuel tank. The vent passage communicates the canister and an intake passage of an engine. The pump is arranged on the vent passage. The pump discharges mixed gas including air and the evaporated fuel retained in the canister to the intake passage. The detector detects a difference between a pressure of the mixed gas discharged by the pump in the vent passage on an intake passage side relative to the pump and a pressure thereof in the vent passage on a canister side relative to the pump (hereinbelow the difference will be termed a pressure difference). A concentration of the evaporated fuel in the mixed gas is estimated from the detected pressure difference.

SUMMARY

In the above technique, even if a concentration of the evaporated fuel in the mixed gas is same, the detected pressure difference may vary due to individual differences in performances of the pump and the detector.

The disclosure herein provides a technique that is capable of accurately estimating a concentration of evaporated fuel in mixed gas, irrelevant to individual differences in performances of a pump and a detector.

An evaporated fuel processing device disclosed herein may comprise: a canister configured to retain evaporated fuel generated in a fuel tank; a vent passage configured to communicate the canister and an intake passage of an engine; a first pump configured to discharge mixed gas including air and the evaporated fuel retained in the canister to the intake passage via the vent passage; a detector configured to detect a first pressure value which indicates a pressure of the mixed gas discharged by the first pump; a memory storing pressure value-concentration correlated data which indicates a correlation relationship between a second pressure value indicating a pressure of mixed gas discharged by a second pump which is different from the first pump and a concentration of evaporated fuel contained in the mixed gas discharged by the second pump; an estimation unit configured to estimate a concentration of the evaporated fuel contained in the mixed gas discharged by the first pump by using the first pressure value and the pressure value-concentration correlated data stored in the memory; and an acquisition unit configured to acquire a third pressure value which indicates a pressure of air detected by the detector in a case where the air that contains substantially no evaporated fuel is discharged by the first pump. In a case where the third pressure value has been acquired, the estimation unit may estimate the concentration of the evaporated fuel contained in the mixed gas discharged by the first pump by using the acquired third pressure value and the pressure value-concentration correlated data stored in the memory.

For example, in a case where there are individual differences between a performance of the first pump that is actually installed in a vehicle and a performance of the second pump, a deviation from an actual concentration of the evaporated fuel may cause with a configuration in which a concentration corresponding to the detected first pressure value is estimated as the concentration of the evaporated fuel merely according to the pressure value-concentration correlated data based on the second pump. In the aforementioned configuration, the third pressure value is detected by using the first pump and the detector that are actually installed in the vehicle in a situation where the air containing no evaporated fuel (that is, gas whose concentration of the evaporated fuel is substantially 0%) is discharged. According to this configuration, the concentration is estimated by using the third pressure value, which is detected by using the first pump and the detector that are actually installed in the vehicle, in addition to the pressure value-concentration correlated data based on the second pump. Thus, the concentration of the evaporated fuel in which the individual differences of the pump and the detector are taken into account can be estimated.

The evaporated fuel processing device may further comprise: a communication passage connected to the canister, and configured to communicate open air and the vent passage via the canister. The first pump may be disposed on the vent passage. The third pressure value may indicate a pressure of the air detected by the detector in a case where the canister retains no evaporated fuel. According to this configuration, no evaporated fuel is mixed into the air even when the air flows through the canister. Due to this, the third pressure value indicating the pressure value of the air containing no evaporated fuel can be detected by the detector.

The evaporated fuel processing device may further comprise: a communication passage configured to communicate open air and the vent passage; and a switching valve disposed on the vent passage, and connected to the communication passage. The first pump may be disposed on the vent passage on an intake passage side relative to the switching valve. The switching valve may be configured to switch between a first switching state and a second switching state, the first switching state may be a state in which the first pump and the canister communicate with each other via the vent passage and communication between the first pump and the communication passage is cut off on the vent passage, and the second switching state may be a state in which the first pump and the communication passage communicate with each other via vent passage and communication between the first pump and the canister is cut off on the vent passage. The first pressure value may indicate a pressure of the mixed gas detected by the detector in the first switching state. The third pressure value may indicate a pressure of the air detected by the detector in the second switching state. According to this configuration, the air is discharged by the first pump without intervention of the canister in the second switching state. Due to this, the third pressure value can be detected by the detector regardless of whether or not the evaporated fuel is retained in the canister.

DETAILED DESCRIPTION

First Embodiment

Figure 1:
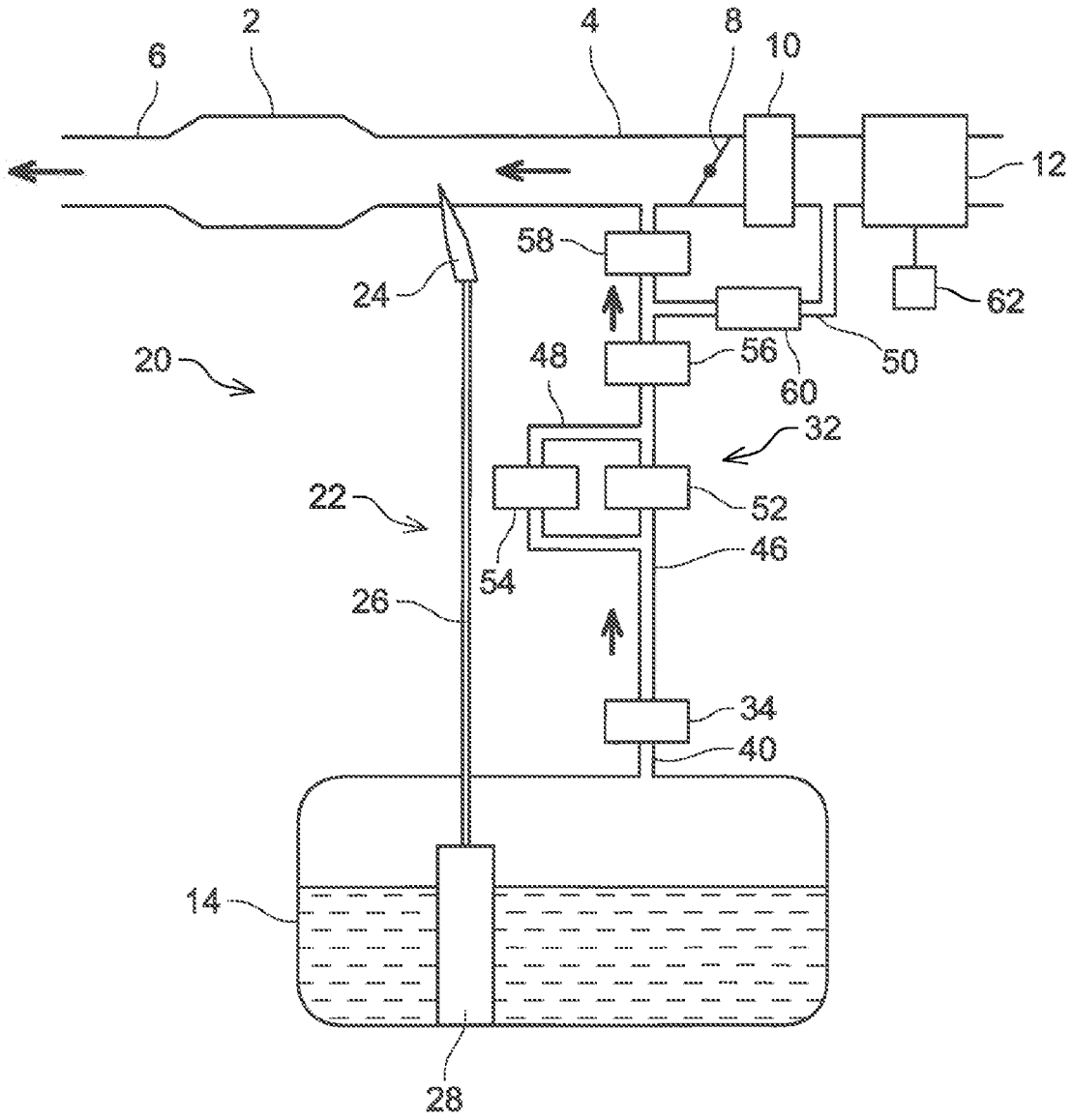
FIG. 1 shows a fuel supply system using an evaporated fuel processing device according to a first embodiment.

An evaporated fuel processing device 32 according to a first embodiment will be described with reference to FIGS. 1 to 6. As shown in FIG. 1, the evaporated fuel processing device 32 is arranged in a fuel supply system 20 installed in a vehicle. The fuel supply system 20 comprises a main supply unit 22 and the evaporated fuel processing device 32. The main supply unit 22 is configured to supply fuel retained in a fuel tank 14 to an engine 2. The evaporated fuel processing device 32 is configured to supply evaporated fuel generated in the fuel tank 14 to an intake passage 4.

The main supply unit 22 comprises a fuel pump 28, a supply passage 26, and an injector 24. The fuel pump 28 is housed in the fuel tank 14. The supply passage 26 is connected to the fuel pump 28 and the injector 24. The fuel pump 28 is configured to supply the fuel retained in the fuel tank 14 to the injector 24 through the supply passage 26. The injector 24 comprises a solenoid valve. An aperture of this solenoid valve is controlled by an engine control unit (ECU) 80 (see FIG. 3) to be described later. When the solenoid valve of the injector 24 opens, the fuel is supplied to the engine 2.

The engine 2 has the intake passage 4 and an exhaust passage 6 connected thereto. The intake passage 4 has an air cleaner 12 arranged thereon. The air cleaner 12 comprises a filter that is not shown. The filter is configured to remove foreign particles in air flowing in the intake passage 4.

A throttle valve 8 is arranged on the intake passage 4. When the throttle valve 8 opens, air flows in from the air cleaner 12 toward the engine 2. An aperture of the throttle valve 8 is controlled by the ECU 80. Due to this, an air amount to flow into the engine 2 is controlled.

A supercharger 10 is arranged on the intake passage 4 between the air cleaner 12 and the throttle valve 8. The supercharger 10 comprises a turbine that is not shown. The turbine is configured to be rotated by exhaust gas discharged from the engine 2 to the exhaust passage 6. Due to this, the supercharger 10 pressurizes air in the intake passage 4 and supplies the air to the engine 2.

(Configuration of Evaporated Fuel Processing Device)

Figure 2:
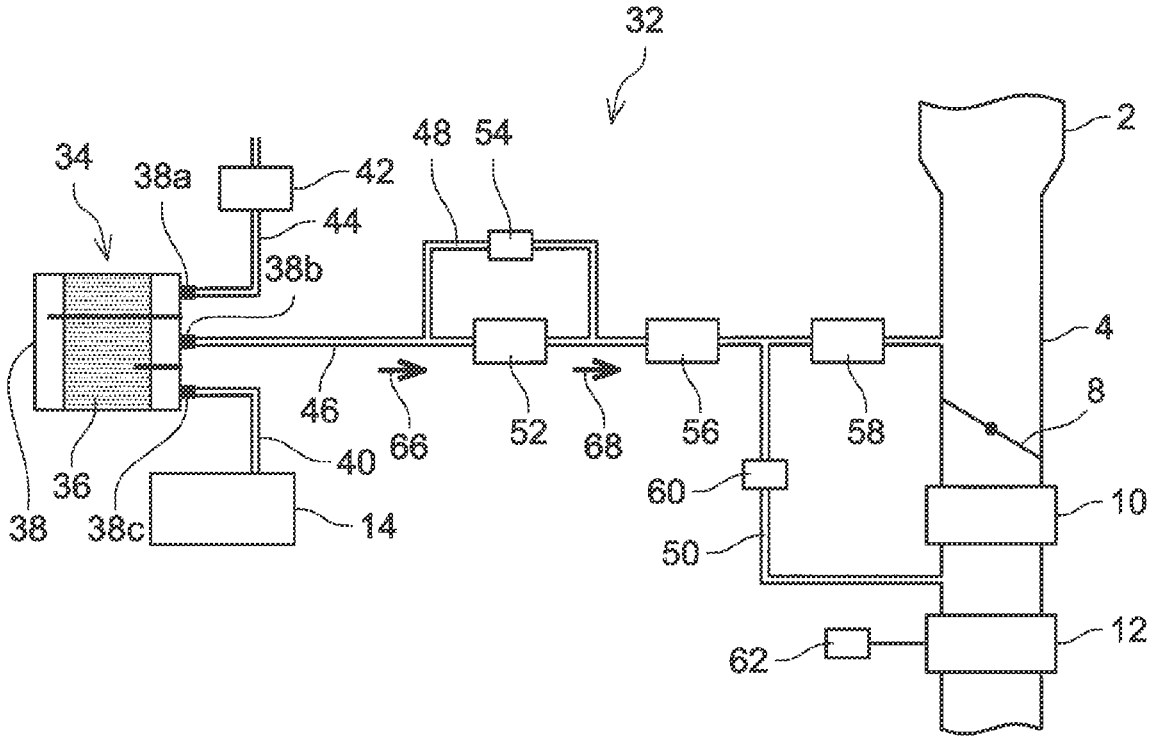
FIG. 2 shows the evaporated fuel processing device according to the first embodiment.

As shown in FIG. 2, the evaporated fuel processing device 32 comprises a canister 34, an air filter 42, communication passages 40, 44, vent passages 46, 50, a pump 52, a control valve 56, a branch passage 48, a pressure difference sensor 54, check valves 58, 60, and a temperature sensor 62. The canister 34 comprises an activated charcoal 36 and a casing 38. The casing 38 comprises an air port 38*a*, a vent port 38*b*, and a tank port 38*c*. The air port 38*a* has the communication passage 44 connected thereto. The communication passage 44 communicates with open air. The communication passage 44 has the air filter 42 arranged thereon. The air filter 42 removes foreign particles from air that is to flow into the canister 34 through the air port 38*a*.

The tank port 38*c* has the communication passage 40 connected thereto. The communication passage 40 is connected to the fuel tank 14. The communication passage 40 communicates the fuel tank 14 and the canister 34. The evaporated fuel generated in the fuel tank 14 flows through the communication passage 40 and enters the canister 34 from the tank port 38*c*. The activated charcoal 36 absorbs the evaporated fuel. The canister 34 thereby retains the evaporated fuel. Due to this, discharge of the evaporated fuel to the open air though the air port 38*a*, the communication passage 44, and the air filter 42 can be suppressed.

The vent port 38*b* has the vent passage 46 connected thereto. The vent passage 46 communicates with the canister 34. The evaporated fuel retained in the canister 34 is mixed with the air flowing into the canister 34 through the air port 38*a*, and this mixed gas is supplied to the vent passage 46 through the vent port 38*b*. Hereinbelow, the mixed gas will be termed "purge gas".

The vent passage 46 is connected to the intake passage 4 between the throttle valve 8 and the engine 2. That is, the vent passage 46 is connected to the intake passage 4 and the canister 34. The vent passage 46 communicates with the intake passage 4. The purge gas is supplied to the intake passage 4 through the vent passage 46.

The pump 52 is arranged at an intermediate position on the vent passage 46. The pump 52 is configured to discharge the purge gas to the intake passage 4. The pump 52 may supply air containing no evaporated fuel to the intake passage 4, in some cases. In this embodiment, unless it is intentionally distinguished, such cases will also be expressed as "the pump discharges the purge gas (that is, the purge gas whose evaporated fuel concentration is 0%)". Specifically, the pump 52 is configured to draw in the purge gas through the vent passage 46 in a direction of an arrow 66 shown in FIG. 2 and discharge the purge gas through the vent passage 46 toward the intake passage 4 in a direction of an arrow 68 shown in FIG. 2.

The control valve 56 is arranged on the vent passage 46 on an intake passage 4 side relative to the pump 52. The control valve 56 is a solenoid valve. The control valve 56 is configured to be in a communication state and a cutoff state. The communication state is a state in which the canister 34 and the intake passage 4 communicate with each other via the vent passage 46. The cutoff state is a state in which communication between the canister 34 and the intake passage 4 is cut off on the vent passage 46. Opening and closing periods (timings to switch between the communication state and the cutoff state) of the control valve 56 are controlled by the ECU 80. Due to this, an amount of the purge gas that is to flow into the intake passage 4 is adjusted. In a variant, the control valve 56 may be a stepping motor-type control valve of which aperture can be adjusted.

The check valve 58 is arranged on the vent passage 46 on the intake passage 4 side relative to the control valve 56. In the vent passage 46, the check valve 58 is configured to allow the purge gas flowing in a direction toward the intake passage 4 from the canister 34 to pass therethrough, while it inhibits the purge gas from flowing in a direction from the intake passage 4 toward the canister 34.

The vent passage 50 is connected to the vent passage 46 between the control valve 56 and the intake passage 4. One end of the vent passage 50 is connected to the intake passage 4 between the supercharger 10 and the air cleaner 12, and another end of the vent passage 50 is connected to the vent passage 46 between the control valve 56 and the check valve 58. The check valve 60 is arranged on the vent passage 50. In the vent passage 50, the check valve 60 is configured to allow the purge gas flowing in the direction toward the intake passage 4 from the canister 34 to pass therethrough, while it inhibits the purge gas from flowing in the direction from the intake passage 4 toward the canister 34.

(Operation of Evaporated Fuel Processing Device)

The evaporated fuel processing device 32 is configured to supply the purge gas to at least one of the intake passage 4 between the throttle valve 8 and the engine 2 through the vent passage 46 and the intake passage 4 between the supercharger 10 and the air cleaner 12 through the vent passage 46 and the vent passage 50. Specifically, in a case where the supercharger 10 is not operating, the intake passage 4 is maintained in a negative pressure by operation of the engine 2. In this case, the purge gas flows into the intake passage 4 mainly through the vent passage 46. In this case, the purge gas can be supplied by a pressure difference between the vent passage 46 and the intake passage 4 even if the pump 52 is not operating. However, in a case where the pressure difference between the vent passage 46 and the intake passage 4 is small and in a case where a flow rate of the purge gas should be increased, the pump 52 may be operated to adjust the flow rate of the purge gas.

On the other hand, in a case where the supercharger 10 is operating, the intake passage 4 on an engine 2 side relative to the supercharger 10 has a pressure higher than an atmospheric pressure. Due to this, the purge gas flows into the intake passage 4 mainly through the vent passage 50. The intake passage 4 on an air cleaner 12 side relative to the supercharger 10 has the atmospheric pressure. Due to this, the pump 52 is operated to supply the purge gas to the intake passage 4.

The vent passage 46 further has the branch passage 48 connected thereto. One end of the branch passage 48 is connected to the vent passage 46 between the control valve 56 and the pump 52, and another end of the branch passage 48 is connected to the vent passage 46 between the pump 52 and the canister 34. The pressure difference sensor 54 is arranged on the branch passage 48. The pressure difference sensor 54 is configured to detect a difference between a pressure in the vent passage 46 on the intake passage 4 side relative to the pump 52 and a pressure in the vent passage 46 on the canister 34 side relative to the pump 52 (hereinbelow this difference will be termed a pressure difference). The pressure difference sensor 54 is configured to detect the pressure difference in the purge gas discharged by the pump 52.

The air cleaner 12 has the temperature sensor 62 connected thereto. The temperature sensor 62 is configured to detect a temperature of the air flowing in the air cleaner 12.

Figure 3:
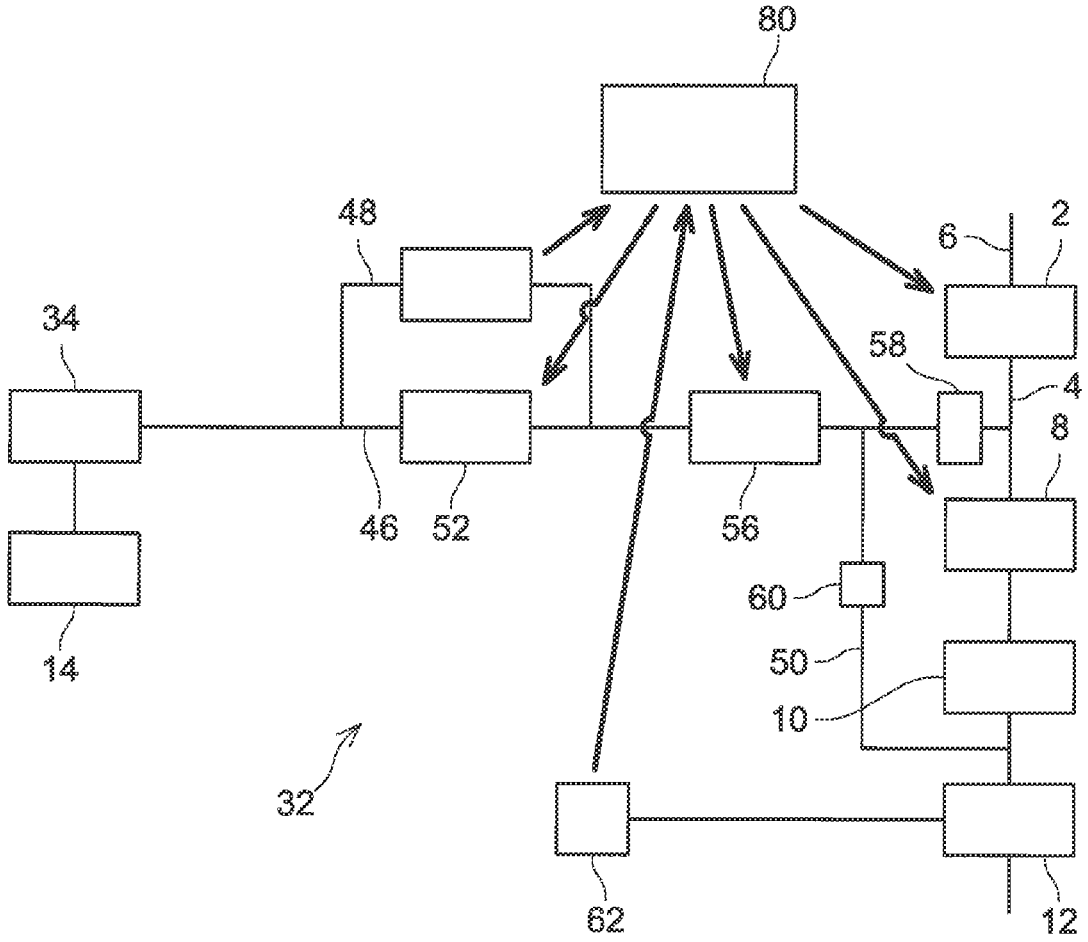
FIG. 3 shows an evaporated fuel supply system according to the first embodiment.

The ECU 80 is installed in the vehicle. The ECU 80 is constituted of a CPU, a memory, and the like. As shown in FIG. 3, the ECU 80 is communicably connected to the engine 2, the throttle valve 8, the pump 52, the pressure difference sensor 54, the control valve 56, and the temperature sensor 62. The ECU 80 controls the engine 2, the throttle valve 8, the pump 52, and the control valve 56. The ECU 80 selectively switches the control valve 56 between the communication state and the cutoff state. The ECU 80 acquires the pressure difference detected by the pressure difference sensor 54 and stores the same. The ECU 80 acquires an air temperature detected by the temperature sensor 62 and stores the same.

Figure 4:
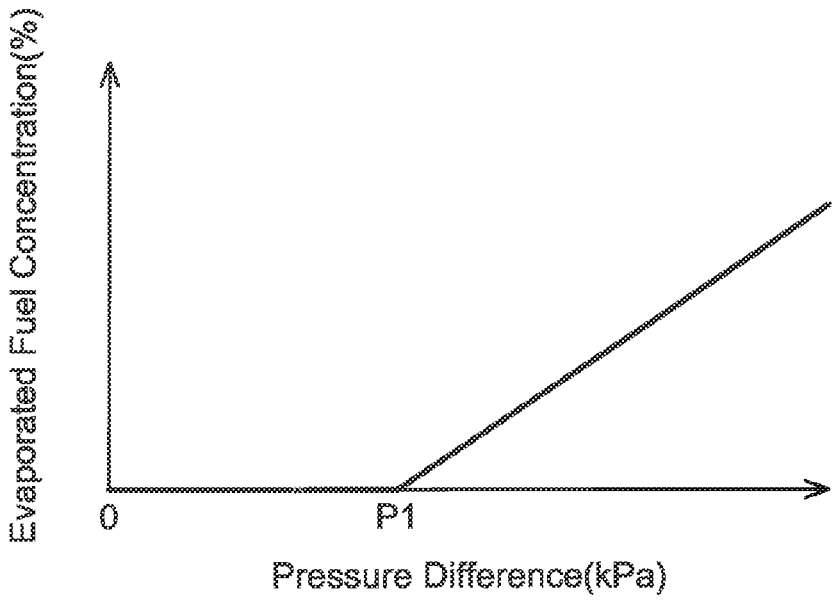
FIG. 4 shows pressure difference-concentration correlated data according to the first embodiment.

The ECU 80 stores pressure difference-concentration correlated data. The pressure difference-concentration correlated data indicates a correlation relationship between pressure difference and evaporated fuel concentration. The pressure difference-concentration correlated data is specified in advance by experiments. The experiments for specifying the pressure difference-concentration correlated data are carried out under a reference temperature (such as 20° C.), and use an experimental pump and an experimental pressure difference sensor. The experimental pump has same specs as those of the pump 52 installed in the vehicle, however, it is a separate individual from the pump 52. Due to this, even if they were manufactured according to a same manufacturing process, the experimental pump and the pump 52 may have individual differences due to dimensional errors and the like. In such a case, even if the experimental pump and the pump 52 are operated under a same condition (e.g., with a same power), their performances to increase a pressure of the purge gas may differ. The experimental pressure difference sensor has same specs as those of the pressure difference sensor 54 installed in the vehicle, however, it is a separate individual from the pressure difference sensor 54. Due to this, even if they were manufactured according to a same manufacturing process, the experimental pressure difference sensor and the pressure difference sensor 54 may have individual differences due to errors and the like of circuit elements. In such a case, even if the experimental pressure difference sensor and the pressure difference sensor 54 detect pressure differences in a same environment, these pressure differences may be different from each other FIG. 4 shows the pressure difference-concentration correlated data. In FIG. 4, a horizontal axis indicates the pressure difference (kPa) and a vertical axis indicates the evaporated fuel concentration (%). In the pressure difference-concentration correlated data, the evaporated fuel concentration is zero in a range where the pressure difference is from zero to a reference pressure difference P1, and the evaporated fuel concentration gradually increases in proportion to the pressure difference in a range where the pressure difference exceeds the reference pressure difference P1. The reference pressure difference P1 indicates a pressure difference in air discharged by the experimental pump, which was detected by the experimental pressure difference sensor.

The ECU 80 is configured to estimate the evaporated fuel concentration of the purge gas flowing into the intake passage 4 by using the pressure difference-concentration correlated data stored in the ECU 80 and the pressure difference and the air temperature stored in the ECU 80.

(Reference Pressure Difference Learning Process)

The individual performance differences of the experimental pump and the experimental pressure difference sensor are not taken into account in the pressure difference-concentration correlated data stored in the ECU 80. For example, a reference pressure difference varies depending on the individual performance differences of the pump 52 and the pressure difference sensor 54. Due to this, when such individual differences are large, a deviation may occur between the evaporated fuel concentration estimated by using the pressure difference-concentration correlated data stored in the ECU 80 and the actual evaporated fuel concentration. Further, the performances of the pump 52 and the pressure difference sensor 54 deteriorate due to a long-term use of the pump 52 and the pressure difference sensor 54. Due to this, if such deteriorations in the performances of the pump 52 and the pressure difference sensor 54 are large, a deviation may occur between the evaporated fuel concentration estimated by using the pressure difference-concentration correlated data stored in the ECU 80 and the actual evaporated fuel concentration. In the fuel supply system 20, the ECU 80 executes a reference pressure difference learning process for detecting the reference pressure difference by using the pump 52 and the pressure difference sensor 54 installed in the vehicle.

Figure 5:
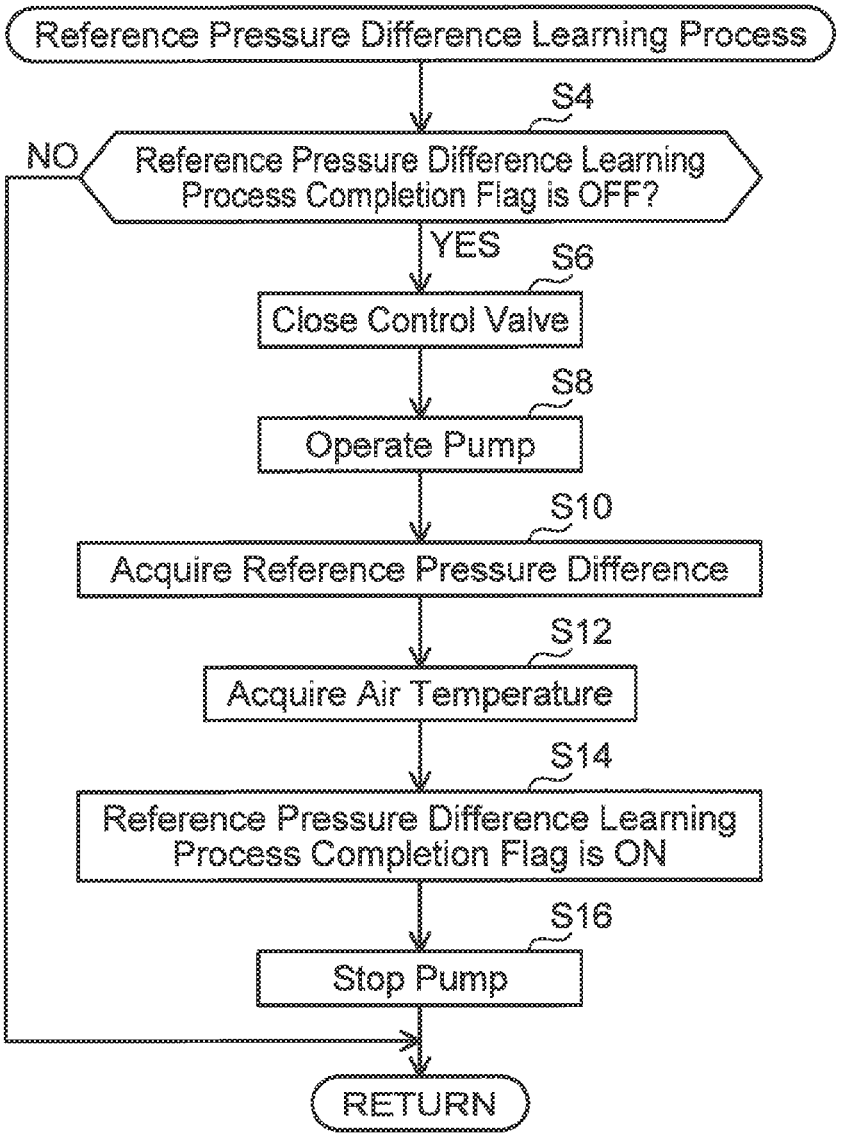
FIG. 5 shows a flowchart of a reference pressure difference learning process according to the first embodiment.

The reference pressure difference learning process will be described with reference to FIG. 5. The reference pressure difference learning process is executed after the fuel supply system 20 has been assembled to the vehicle. The reference pressure difference learning process is executed in a process executable state in which the purge gas that flows from the communication passage 44 through the canister 34 and reaches the pump 52 contains no evaporated fuel, that is, in which the purge gas whose evaporated fuel concentration is 0% is discharged by the pump 52. The process executable state may be described as being a state in which substantially no evaporated fuel is retained in the canister 34. The state in which substantially no evaporated fuel is retained in the canister 34 includes: a state in which the engine 2 has never been started yet after the vehicle had been manufactured; a state in which the engine 2 has never been started yet after the canister 34 had been replaced; and a state in which almost no evaporated fuel is retained in the canister 34 as a result of the purge gas having been supplied to the intake passage 4 in a large amount. The state in which substantially no evaporated fuel is retained in the canister 34 includes a state in which the evaporated fuel is not retained at all in the canister 34, and a state in which the evaporated fuel is retained in the canister 34 but the retained amount thereof is very small, by which the pressure difference detected by the pressure difference sensor 54 while the pump 52 is operating is not different from that in the case of the air. In other words, the evaporated fuel concentration in the purge gas is at a concentration that is equal to or less than a detectable threshold of the pressure difference sensor 54.

In the reference pressure difference learning process, in S4, the ECU 80 firstly determines whether or not a reference pressure difference learning process completion flag is OFF. The ECU 80 stores the reference pressure difference learning process completion flag in advance. In a case of determining that the reference pressure difference learning process completion flag is ON (NO in S4), the ECU 80 skips processes from S6 and returns to S4. On the other hand, in a case of determining that the reference pressure difference learning process completion flag is OFF (YES in S4), the ECU 80 maintains the cutoff state of the control valve 56 in S6. In a variant, the ECU 80 may maintain the communication state of the control valve 56 in S6.

Next, in S8, the ECU 80 operates the pump 52 at a constant rotational speed (such as at 20,000 rpm). The pump 52 thereby discharges the air that had flown through the communication passage 44 and the canister 34, toward the intake passage 4. Due to this, the air that contains substantially no evaporated fuel is discharged from the pump 52. The air that contains substantially no evaporated fuel includes air that does not contain any evaporated fuel, and the purge gas which is a mixture of air that had flown through the canister 34 in the state where the retained amount of the evaporated fuel in the canister 34 is very small and the evaporated fuel in the canister 34. That is, the pressure difference indicating the air that contains substantially no evaporated fuel and detected by the pressure difference sensor 54 is same as the pressure difference indicating the air that is detected by the pressure difference sensor 54.

Next, in S10, the ECU 80 acquires a reference pressure difference detected by the pressure difference sensor 54. The ECU 80 stores the acquired reference pressure difference. In a case where a reference pressure difference is already stored in the ECU 80, the ECU 80 changes the already-stored reference pressure difference to the newly-acquired reference pressure difference and stores the same. Then, in S12, the ECU 80 acquires an air temperature detected by the temperature sensor 62. The ECU 80 stores the acquired air temperature. In a case where an air temperature is already stored in the ECU 80, the ECU 80 changes the already-stored air temperature to the newly-acquired air temperature and stores the same. In this embodiment, a temperature of the air flowing through the air cleaner 12 is assumed as being equal to a temperature of the air flowing through the vent passage 46.

Next, in S14, the ECU 80 switches the reference pressure difference learning process completion flag from OFF to ON. Once the reference pressure difference learning process completion flag is switched to ON, it is maintained in the ON state, that is, it is not switched from ON to OFF except for exceptional cases. For example, in the case where the canister 34 is replaced, the ECU 80 switches the reference pressure difference learning process completion flag from ON to OFF according to a predetermined operation performed by an operator. Further, in the case where substantially no evaporated fuel is retained in the canister 34 as a result of the purge gas having been supplied to the intake passage 4 in a large amount, the ECU 80 switches the reference pressure difference learning process completion flag from ON to OFF. Next, in S16, the ECU 80 stops the pump 52 and terminates the reference pressure difference learning process. The ECU 80 maintains the cutoff state of the control valve 56.

(Purge Gas Supplying Process)

Figure 6:
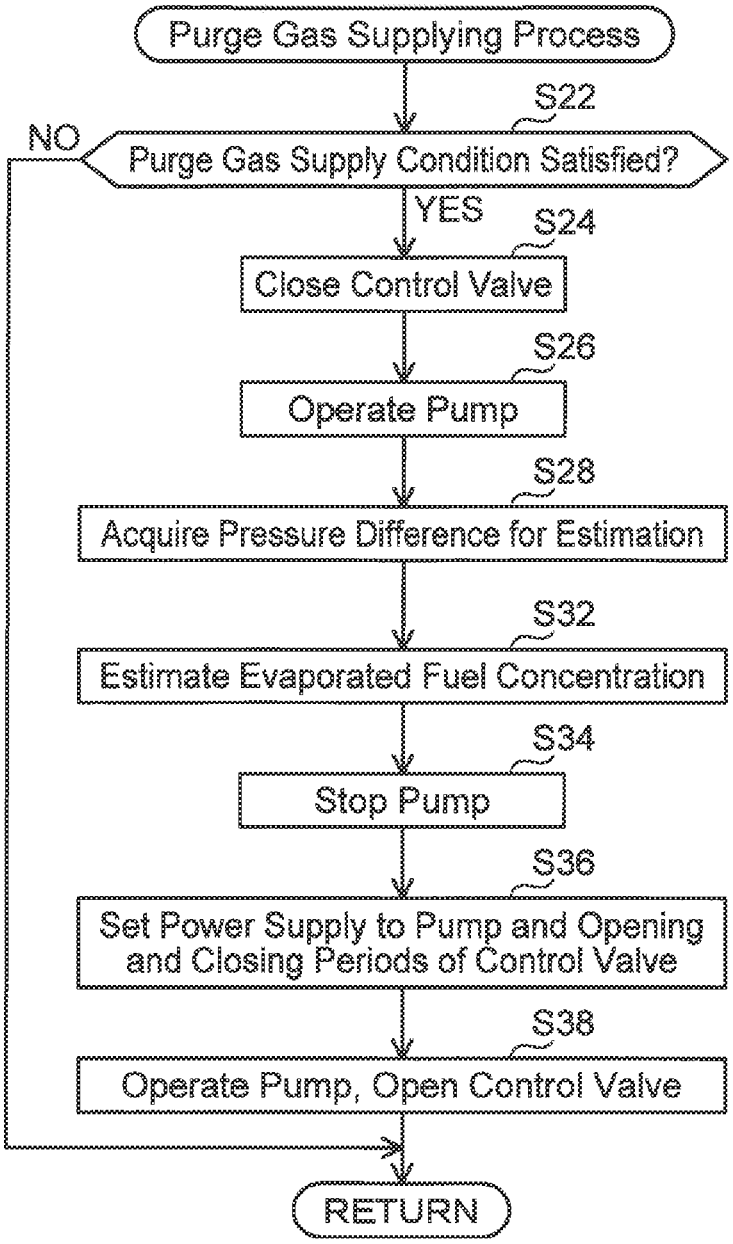
FIG. 6 shows a flowchart of a purge gas supplying process according to the first embodiment.

Next, a purge gas supplying process will be described with reference to FIG. 6. The purge gas supplying process is executed while the engine 2 is operating. In S22, the ECU 80 firstly determines whether or not a purge gas supply condition is satisfied. The purge gas supply condition is a condition that is satisfied when the purge gas supplying process of supplying the purge gas to the engine 2 is to be executed, and is stored in the ECU 80 in advance according to a temperature of cooling water for the engine 2 and a specific situation of the evaporated fuel concentration. The ECU 80 constantly monitors whether or not the purge gas supply condition is satisfied while the engine 2 is operating. In a case where the purge gas supply condition is not satisfied (NO in S22), the ECU 80 skips processes from S24 and returns to S22. In a case where the purge gas supply condition is satisfied (YES in S22), the ECU 80 maintains the cutoff state of the control valve 56 in S24. In a variant, the ECU 80 may maintain the communication state of the control valve 56 in S24.

Next, in S26, the ECU 80 operates the pump 52 at a constant rotational speed (such as at 20,000 rpm). Due to this, when air that had flown through the communication passage 44 flows through the canister 34, the evaporated fuel retained in the canister 34 is mixed with the air. As a result, the purge gas is suctioned into the pump 52 and discharged therefrom. Next, in S28, the ECU 80 acquires a pressure difference for estimation indicating the purge gas detected by the pressure difference sensor 54.

Next, in S32, the ECU 80 estimates an evaporated fuel concentration in the purge gas by using the pressure difference-concentration correlated data, the reference pressure difference acquired in S10, the air temperature acquired in S12, and the pressure difference for estimation acquired in S28. Specifically, the ECU 80 modifies the reference pressure difference acquired in S10 by taking the air temperature acquired in S12 into account. The pressure difference varies according to a density of the purge gas. The density of the purge gas varies according to the evaporated fuel concentration as well as the temperature of the purge gas. The ECU 80 modifies the reference pressure difference acquired in S10 by taking into account a difference between the reference temperature at the time when the experiments for specifying the pressure difference-concentration correlated data were conducted and the air temperature acquired in S12 (that is, a density of the air in the experiments and a density of the air when the reference pressure difference was acquired). Next, the ECU 80 changes the reference pressure difference P1 in the pressure difference-concentration correlated data to the modified reference pressure difference as well as changes the pressure difference-concentration correlated data entirely according to the change of the reference pressure differences. The pressure difference-concentration correlated data before the change is still stored in the ECU 80 even after the change takes place. Due to this, the pressure difference-concentration correlated data is changed to values in which the performances of the pump 52 and the pressure difference sensor 54 installed in the vehicle are taken into account. Next, the ECU 80 estimates the evaporated fuel concentration in the purge gas by using the pressure difference for estimation acquired in S28 and the changed pressure difference-concentration correlated data.

Next, in S34, the ECU 80 stops the pump 52. Then, in S36, the ECU 80 sets power to be supplied to the pump 52 and the opening and closing periods of the control valve 56 by using the evaporated fuel concentration in the purge gas estimated in S32. Then, in S38, the ECU 80 operates the pump 52 with the power to be supplied to the pump 52 that was set in S36. Further, in S38, the ECU 80 maintains the communication state of the control valve 56 according to the opening and closing periods of the control valve 56 set in S36. Due to this, a desired amount of the evaporate fuel can be supplied to the intake passage 4.

In a case where the purge gas supply to the intake passage 4 is to be stopped, the ECU 80 stops the pump 52 after having maintained the cutoff state of the control valve 56.

(Effects)

In S10, the ECU 80 acquires the reference pressure difference indicating the air pressure detected by using the pump 52 and the pressure difference sensor 54 of the evaporated fuel processing device 32. In S12, the ECU 80 acquires the air temperature by using the temperature sensor 62 of the evaporated fuel processing device 32. In S32, the ECU 80 modifies the reference pressure difference acquired in S10 by using the air temperature acquired in S12 and the reference temperature at the time when the experiments for specifying the pressure difference-concentration correlated data were conducted. Next, the ECU 80 changes the reference pressure difference P1 in the pressure difference-concentration correlated data to the modified reference pressure difference as well as changes the pressure difference-concentration correlated data entirely according to the change of the reference pressure differences. Due to this, the change to the pressure difference-concentration correlated data in which the performances of the pump 52 and the pressure difference sensor 54 actually installed in the vehicle are taken into account can be realized. As a result, the ECU 80 can more accurately estimate the evaporated fuel concentration in the purge gas.

The ECU 80 acquires the reference pressure difference indicating the pressure of the air flowing through the canister 34. The canister 34 retains no evaporated fuel. Due to this, the air contains no evaporated fuel. As a result, the ECU 80 can acquire the reference pressure difference indicating the pressure of the air that contains no evaporated fuel.

(Corresponding Relationships)

The pump 52 is an example of "first pump", the experimental pump is an example of "second pump", the pressure difference sensor 54 is an example of "detector", the pressure difference for estimation is an example of "first pressure value", the reference pressure difference is an example of "third pressure value", the pressure difference-concentration correlated data is an example of "pressure value-concentration correlated data", and the ECU 80 is an example of "acquisition unit", "memory", and "estimation unit".

Variant of First Embodiment

Figure 7:
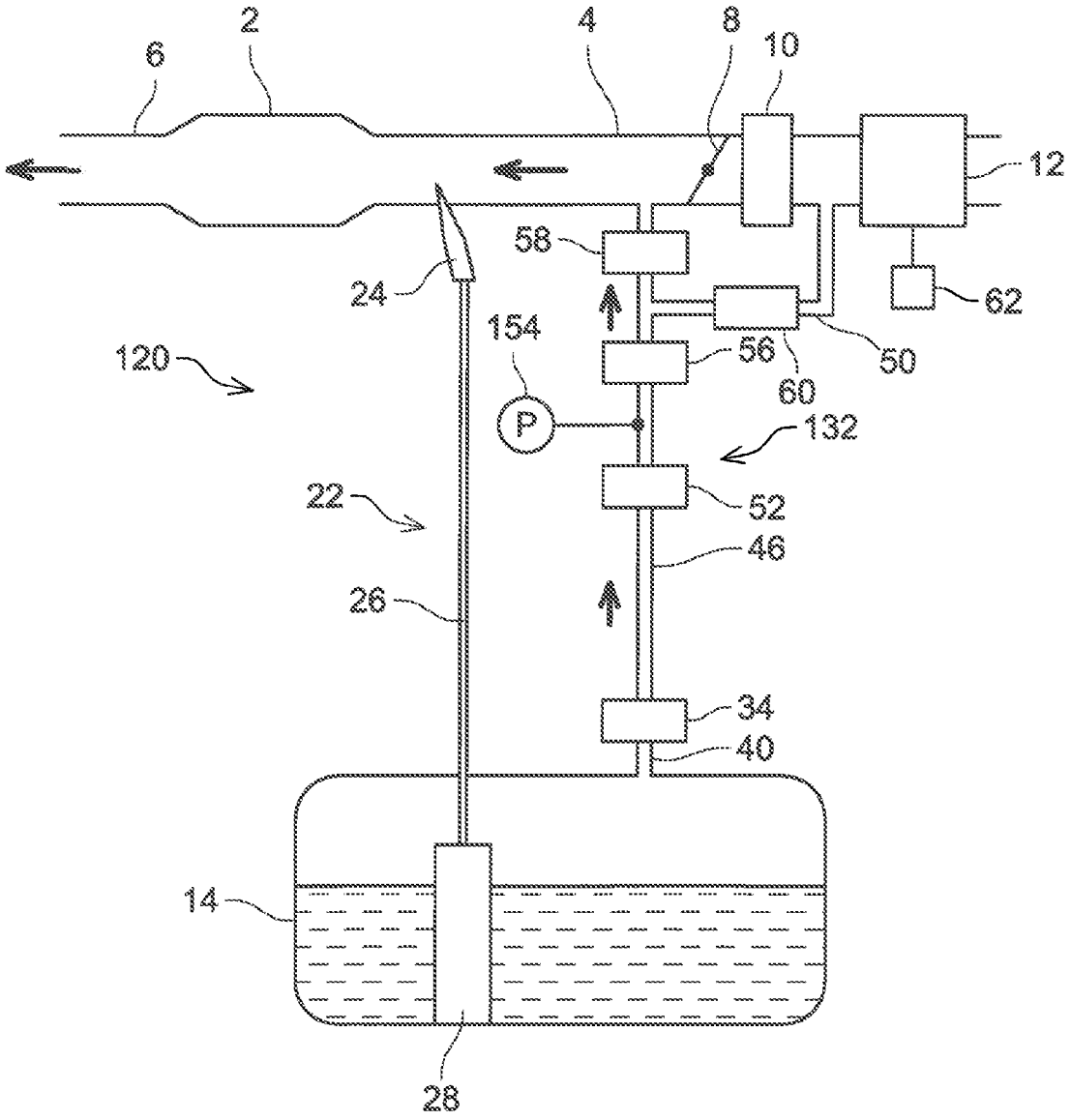
FIG. 7 shows a fuel supply system using an evaporated fuel processing device according to a variant of the first embodiment.

Differences from the first embodiment will be described with reference to FIG. 7. A fuel supply system 120 according to a variant of the first embodiment does not comprise the pressure difference sensor 54 nor the branch passage 48. On the other hand, the fuel supply system 120 further comprises a pressure sensor 154. That is, an evaporated fuel processing device 132 does not comprise the pressure difference sensor 54 nor the branch passage 48, while it further comprises the pressure sensor 154. The pressure sensor 154 is connected to the vent passage 46 between the pump 52 and the control valve 56. That is, the pressure sensor 154 is connected to the vent passage 46 on the intake passage 4 side relative to the pump 52. The pressure sensor 154 is configured to detect a pressure in the vent passage 46 on the intake passage 4 side relative to the pump 52.

The ECU 80 according to the variant of the first embodiment does not store the pressure difference-concentration correlated data but stores pressure-concentration correlated data. The pressure-concentration correlated data indicates a correlation relationship between pressure and evaporated fuel concentration.

In the fuel supply system 20, the reference pressure difference learning process and the purge gas supplying process are executed by using the pressure difference sensor 54, whereas in the fuel supply system 120, a reference pressure learning process and a purge gas supplying process are executed by using the pressure sensor 154. The reference pressure learning process in the fuel supply system 120 differs only in S10 from the reference pressure difference learning process in the fuel supply system 20. In S10, the ECU 80 acquires a reference pressure indicating a pressure of the air detected by the pressure sensor 154 and stores the same.

The purge gas supplying process in the fuel supply system 120 differs only in S28 and S32 from the purge gas supplying process in the fuel supply system 20. In S28, the ECU 80 acquires a pressure for estimation indicating the pressure of the purge gas detected by the pressure sensor 154. In S32, the ECU 80 estimates the evaporated fuel concentration in the purge gas by using the pressure-concentration correlated data, a reference temperature at a time when experiments for specifying the pressure-concentration correlated data were conducted, and the acquired reference pressure, air temperature, and pressure for estimation.

(Corresponding Relationships)

The pressure sensor 154 is an example of "detector", the pressure for estimation is an example of "first pressure value", the reference pressure is an example of "third pressure value", and the pressure-concentration correlated data is an example of "pressure value-concentration correlated data".

Second Embodiment

Figure 8:
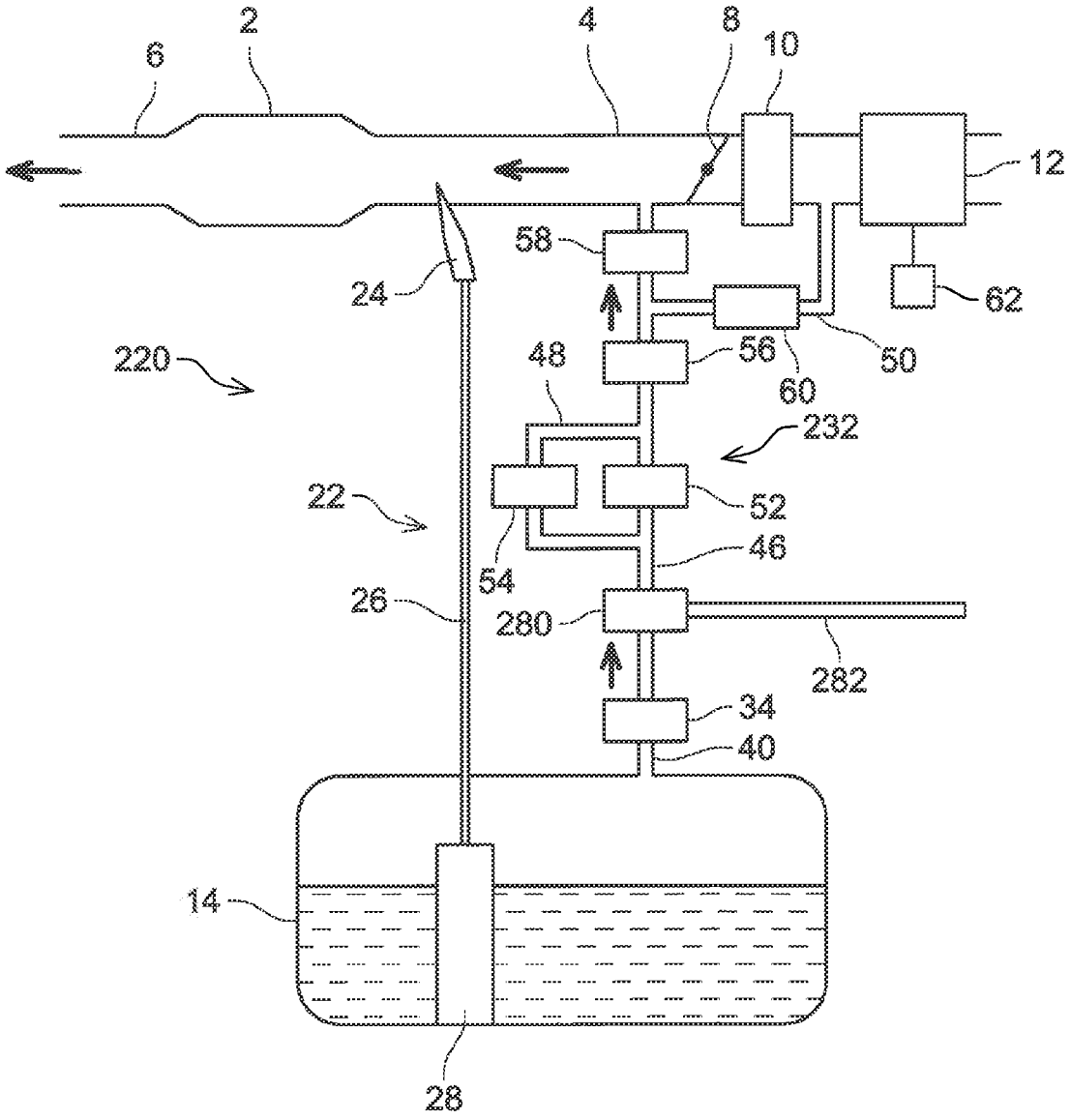
FIG. 8 shows a fuel supply system using an evaporated fuel processing device according to a second embodiment.

Differences from the fuel supply system 20 according to the first embodiment will be described with reference to FIGS. 8 to 11. As shown in FIG. 8, in a fuel supply system 220 according to a second embodiment, a configuration of an evaporated fuel processing device 232 differs from the configuration of the evaporated fuel processing device 32 of the fuel supply system 20. Specifically, the evaporated fuel processing device 232 further comprises a switching valve 280 and a communication passage 282 in addition to the configuration similar to that of the evaporated fuel processing device 32 according to the first embodiment.

The switching valve 280 is arranged on the vent passage 46 between the pump 52 and the canister 34. That is, the pump 52 is arranged on the vent passage 46 on the intake passage 4 side relative to the switching valve 280. The switching valve 280 is arranged on the vent passage 46 on the canister 34 side relative to a point where the vent passage 46 on the canister 34 side relative to the pump 52 is connected to the branch passage 48. The switching valve 280 has the communication passage 282 connected thereto. The communication passage 282 communicates with the open air. That is, the communication passage 282 communicates the open air and the vent passage 46. In a case where the power supplied to the pump 52 is same, a flow resistance of the communication passage 282 is same as a flow resistance of a passage including the communication passage 44, the air filter 42, the canister 34, and the vent passage 46 between the canister 34 and the switching valve 280. Due to this, a pressure loss in the purge gas flowing through the communication passage 282 is same as a pressure loss in the purge gas flowing through the passage including the communication passage 44, the air filter 42, the canister 34, and the vent passage 46 between the canister 34 and the switching valve 280. As a result, a flow rate of the purge gas discharged by the pump 52 through the communication passage 282 is same as a flow rate of the purge gas discharged by the pump 52 through the passage including the communication passage 44, the air filter 42, the canister 34, and the vent passage 46 between the canister 34 and the switching valve 280.

The switching valve 280 is a three-way valve. The switching valve 280 is configured to switch between a first switching state and a second switching state. In the first switching state, the switching valve 280 communicates the pump 52 and the canister 34 via the vent passage 46, while it cuts off communication between the pump 52 and the communication passage 282 on the vent passage 46. As a result, the fuel tank 14 and the intake passage 4 communicates with each other via the canister 34, and the open air and the intake passage 4 communicates with each other via the canister 34. Due to this, the purge gas is supplied to the intake passage 4. In the second switching state, the switching valve 280 communicates the pump 52 and the communication passage 282 via the vent passage 46, while it cuts off the communication between the pump 52 and the canister 34 on the vent passage 46. As a result, the open air and the intake passage 4 communicates with each other via the communication passage 282. Due to this, the air is supplied to the intake passage 4.

Figure 9:
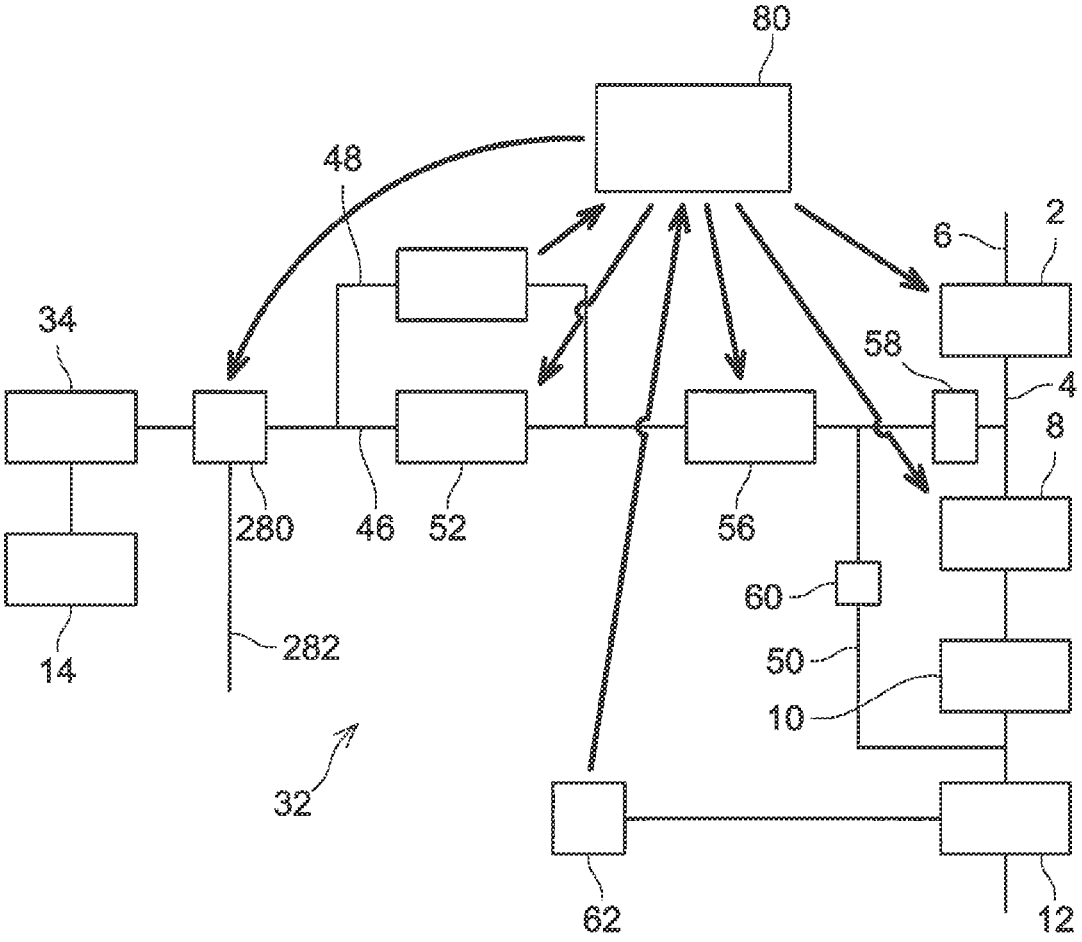
FIG. 9 shows an evaporated fuel supply system according to the second embodiment.

As shown in FIG. 9, the ECU 80 is communicably connected to the switching valve 280, in addition to the engine 2, the throttle valve 8, the pump 52, the pressure difference sensor 54, the control valve 56, and the temperature sensor 62. The ECU 80 controls the switching valve 280. Specifically, the ECU 80 selectively switches the switching valve 280 between the first switching state and the second switching state.

The performances of the pump 52 and the pressure difference sensor 54 deteriorate due to the long-term use of the pump 52 and the pressure difference sensor 54. Due to this, if such performance deteriorations of the pump 52 and the pressure difference sensor 54 are large, a deviation may occur between an evaporated fuel concentration estimated by using the pressure difference-concentration correlated data stored in the ECU 80 and the actual evaporated fuel concentration. In the fuel supply system 220, the ECU 80 executes a reference pressure difference learning process for detecting a reference pressure difference by using the switching valve 280 and the pump 52 and the pressure difference sensor 54 installed in the vehicle.

(Reference Pressure Difference Learning Process)

Figure 10:
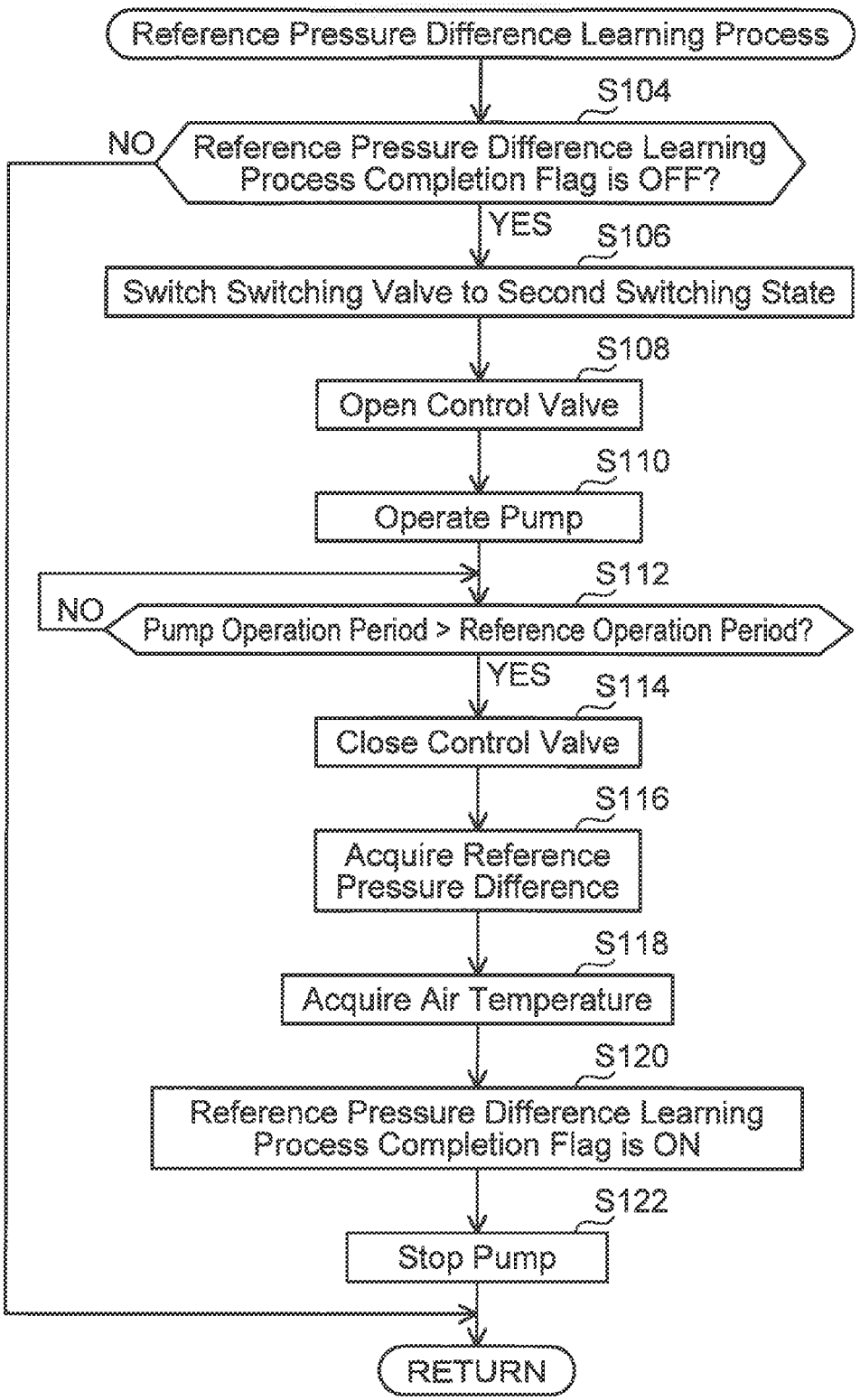
FIG. 10 shows a flowchart of a reference pressure difference learning process according to the second embodiment.

The reference pressure difference learning process will be described with reference to FIG. 10. The reference pressure difference learning process is executed each time before the start of the engine 2 (e.g., each time when a vehicle door is opened or closed). The reference pressure difference learning process is executed regardless of whether or not the evaporated fuel is retained in the canister 34. In the reference pressure difference learning process, in S104, the ECU 80 firstly executes a process similar to S4. Then, in S106, the ECU 80 switches the switching valve 280 from the first switching state to the second switching state, and maintains the second switching state. Due to this, the open air and the intake passage 4 communicates via the communication passage 282. The ECU 80 skips S106 in a case where the switching valve 280 is already in the second switching state.

Next, in S108, the ECU 80 maintains the communication state of the control valve 56. Then, in S110, the ECU 80 operates the pump 52 at a constant rotational speed (such as at 2,000 rpm). Due to this, in S110, air is supplied to the intake passage 4 through the communication passage 282. As a result, the purge gas remaining in the vent passage 46 (the purge gas that remains after the purge gas supply has been terminated) is discharged to the intake passage 4 by the pump 52. Next, in S112, the ECU 80 determines whether or not a pump operation period has exceeded a reference operation period. The ECU 80 includes a timer for measuring a period during which the pump 52 is stopped. When starting to operate the pump 52, the ECU 80 starts the timer. Further, the ECU 80 stores the reference operation period in advance. The reference operation period is a period of time required to discharge the purge gas in the vent passage 46 to outside the vent passage 46, and is specified in advance by experiments. In a case where the pump operation period has not exceeded the reference operation period (NO in S112), the ECU 80 waits until the pump operation period exceeds the reference operation period. This case means that the discharge of the purge gas from the vent passage 46 is not completed. In a case where the pump operation period has exceeded the reference operation period (YES in S112), the ECU 80 proceeds to S114. This case means that the discharge of the purge gas from the vent passage 46 is completed.

Next, in S114, the ECU 80 maintains the cutoff state of the control valve 56. Then, in S116, the ECU 80 executes a process similar to S10. In this case, the air does not flow through the canister 34, thus it contains no evaporated fuel. As a result, the ECU 80 acquires the reference pressure difference indicating the pressure of the air containing no evaporated fuel, and stores the same. If a reference pressure difference is already stored in the ECU 80, the ECU 80 changes the already-stored reference pressure difference to the newly-acquired reference pressure difference and stores the same. The canister 34 is in one of the state of retaining no evaporated fuel and the state of retaining the evaporated fuel. Next, in S118 to S122, the ECU 80 executes processes similar to S12 to S16. The ECU 80 executes the reference pressure difference learning process, and maintains the reference pressure difference learning process completion flag in the ON state from the start of the engine 2 until the stop of the engine 2. When the engine 2 stops, the ECU 80 switches the reference pressure difference learning process completion flag from ON to OFF. That is, the reference pressure difference learning process is executed once within a period from the start of the reference pressure difference learning process until the engine 2 is stopped. Due to this, even in the case where the performances of the pump 52 and the pressure difference sensor 54 are deteriorated due to the long-term use, the ECU 80 can acquire the reference pressure difference in which the deteriorated performances of the pump 52 and the pressure difference sensor 54 are took into account.

Figure 11:
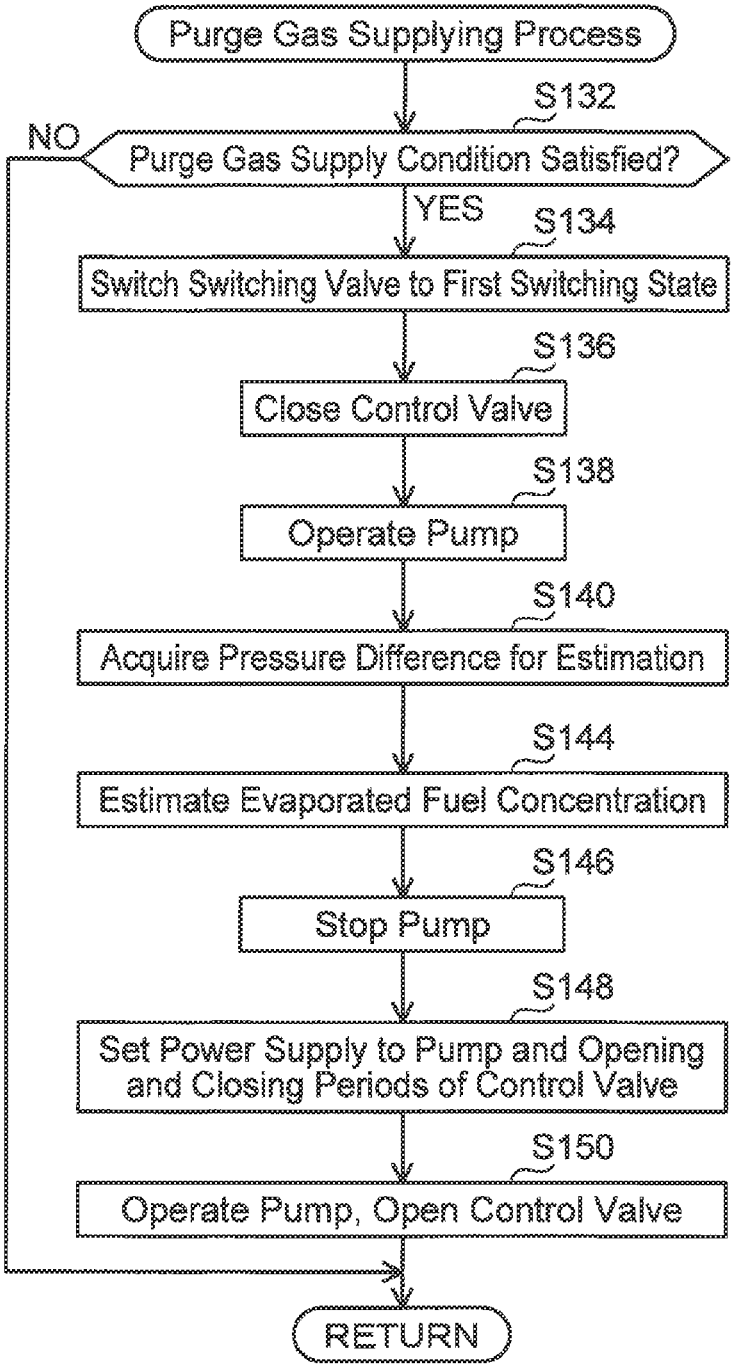
FIG. 11 shows a flowchart of a purge gas supplying process according to the second embodiment.

A purge gas supplying process will be described with reference to FIG. 11. In the purge gas supplying process, in S132, the ECU 80 firstly executes a process similar to S22. Next, in S134, the ECU 80 switches the switching valve 280 from the second switching state to the first switching state, and maintains the first switching state. Due to this, the canister 34 and the intake passage 4 communicate with each other. The ECU 80 skips S134 in a case where the switching valve 280 is already in the first switching state. Then, in S136 to S140, the ECU 80 executes processes similar to S24 to S28. Due to this, a pressure difference for estimation indicating the purge gas detected by the pressure difference sensor 54 in the first switching state is acquired by the ECU 80. Then, in S144, the ECU 80 executes a process similar to S32. Due to this, the evaporated fuel concentration in the purge gas is estimated by the ECU 80. Next, in S146 to S150, the ECU 80 executes processes similar to S34 to S38. Due to this, a desired amount of the evaporated fuel can be supplied to the intake passage 4.

In a case of stopping the purge gas supply to the intake passage 4, the ECU 80 stops the pump 52 after having maintained the cutoff state of the control valve 56.

(Effects)

The switching valve 280, which has the communication passage 282 communicating with the open air connected thereto, is configured to be in the first switching state and the second switching state. In the second switching state, the pump 52 and the communication passage 282 communicate via the vent passage 46, while communication between the pump 52 and the canister 34 is cut off on the vent passage 46. In S116, the switching valve 280 is maintained in the second switching state, and the ECU 80 acquires the reference pressure difference indicating the pressure of the air that did not flow through the canister 34 (that is, the air containing no evaporated fuel). Due to this, the ECU 80 can acquire the reference pressure difference indicating the air pressure regardless of whether or not the evaporated fuel is retained in the canister 34.

Variant of Second Embodiment

Figure 12:
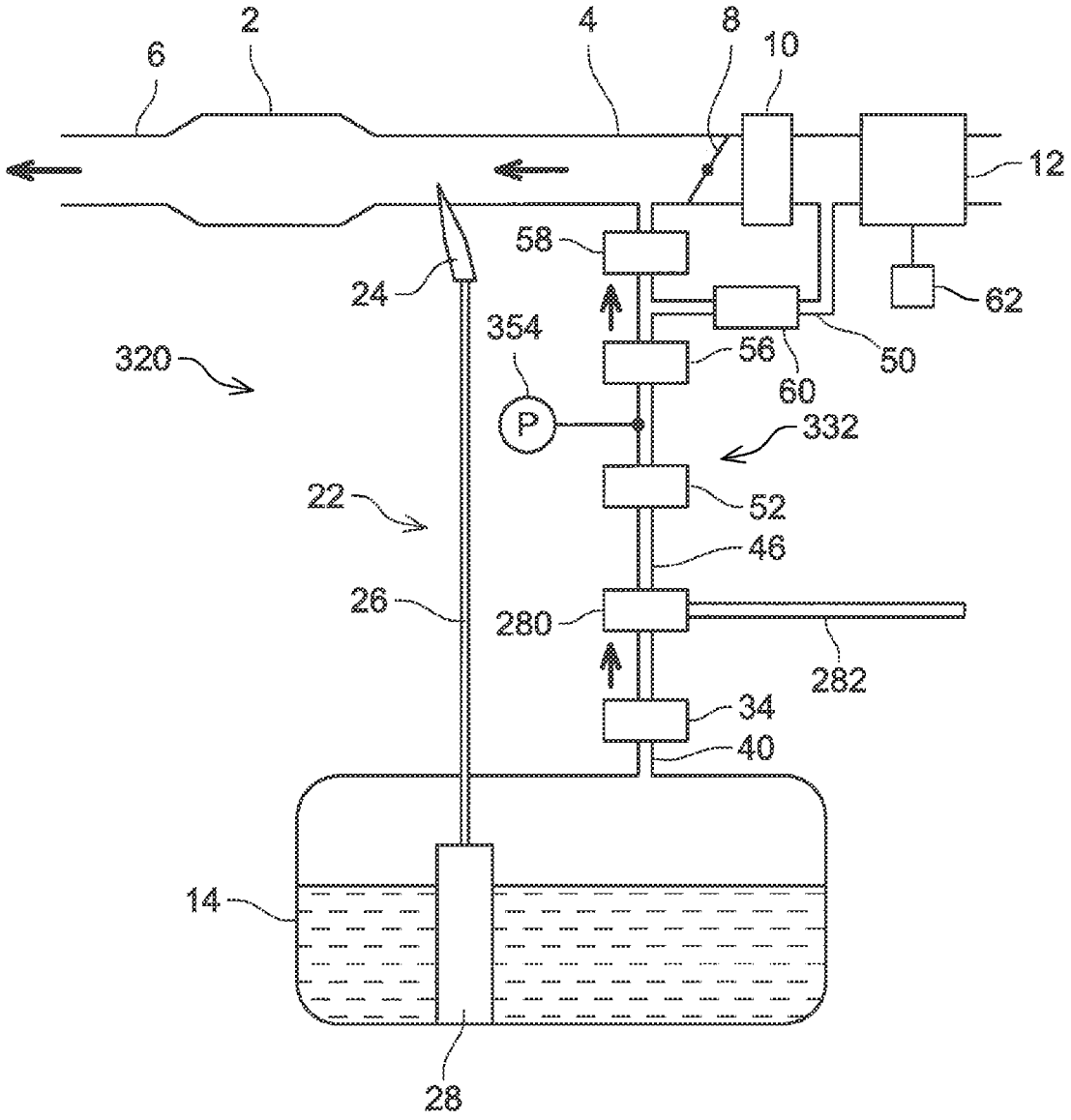
FIG. 12 shows a fuel supply system using an evaporated fuel processing device according to a variant of the second embodiment.

Differences from the second embodiment will be described with reference to FIG. 12. A fuel supply system 320 according to a variant of the second embodiment does not comprise the pressure difference sensor 54 nor the branch passage 48. On the other hand, the fuel supply system 320 further comprises a pressure sensor 354. That is, an evaporated fuel processing device 332 does not comprise the pressure difference sensor 54 nor the branch passage 48, while it further comprises the pressure sensor 354. The pressure sensor 354 is connected to the vent passage 46 between the pump 52 and the control valve 56. That is, the pressure sensor 354 is connected to the vent passage 46 on the intake passage 4 side relative to the pump 52. The pressure sensor 354 is configured to detect a pressure in the vent passage 46 on the intake passage 4 side relative to the pump 52.

The ECU 80 according to the variant of the second embodiment does not store the pressure difference-concentration correlated data but stores pressure-concentration correlated data. The pressure-concentration correlated data indicates a correlation relationship between pressure and evaporated fuel concentration.

In the fuel supply system 220, the reference pressure difference learning process and the purge gas supplying process are executed by using the pressure difference sensor 54, whereas in the fuel supply system 320, a reference pressure learning process and a purge gas supplying process are executed by using the pressure sensor 354. The reference pressure learning process in the fuel supply system 320 differs only in S116 from the reference pressure learning process in the fuel supply system 220. In S116, the ECU 80 acquires a reference pressure indicating a pressure of the air detected by the pressure sensor 354, and stores the same.

The purge gas supplying process in the fuel supply system 320 differs only in S140 and S144 from the purge gas supplying process in the fuel supply system 220. In S140, the ECU 80 acquires a pressure for estimation indicating the pressure of the purge gas detected by the pressure sensor 354. In S144, the ECU 80 estimates the evaporated fuel concentration in the purge gas by using the pressure-concentration correlated data, a reference temperature at the time when the experiments for specifying the pressure-concentration correlated data were conducted, and the acquired reference pressure, air temperature, and pressure for estimation.

Specific examples of the present invention has been described in detail, however, these are mere exemplary indications and thus do not limit the scope of the claims. The art described in the claims include modifications and variations of the specific examples presented above.

(Variant)

(1) In the above embodiments, the evaporated fuel processing devices 32, 232 each comprise the pressure difference sensor 54. However, instead of the pressure difference sensor 54, the evaporated fuel processing devices 32, 232 each may comprise pressure sensors arranged respectively on the vent passage 46 on the canister 34 side relative to the pump 52 and on the vent passage 46 between the pump 52 and the control valve 56. Due to this, the ECU 80 may acquire pressures indicating the purge gas on upstream and downstream sides of the pump 52. In this case, the evaporated fuel processing devices 32, 232 each may not comprise the branch passage 48.

(2) In the above embodiments, the supercharger 10 is installed in the vehicle. However, no limitation is placed on the configurations described in the above embodiments. For example, the supercharger 10 may not be installed in the vehicle. In this case, the evaporated fuel processing devices 32, 132, 232, 332 each may not comprise the vent passage 50 nor the check valve 60.

Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. An evaporated fuel processing device comprising:

a canister configured to retain evaporated fuel generated in a fuel tank;

a vent passage configured to communicate the canister and an intake passage of an engine;

a first pump configured to discharge mixed gas including air and the evaporated fuel retained in the canister to the intake passage via the vent passage;

a detector configured to detect a first pressure value which indicates a pressure of the mixed gas discharged by the first pump;

a memory storing pressure value-concentration correlated data which indicates a correlation relationship between a second pressure value indicating a pressure of mixed gas discharged by a second pump which is different from the first pump and a concentration of evaporated fuel contained in the mixed gas discharged by the second pump;

an estimation unit configured to estimate a concentration of the evaporated fuel contained in the mixed gas discharged by the first pump by using the first pressure value and the pressure value-concentration correlated data stored in the memory; and an acquisition unit configured to acquire a third pressure value which indicates a pressure of air detected by the detector in a case where the air that contains substantially no evaporated fuel is discharged by the first pump, wherein in a case where the third pressure value has been acquired, the estimation unit estimates the concentration of the evaporated fuel contained in the mixed gas discharged by the first pump by using the acquired third pressure value and the pressure value-concentration correlated data stored in the memory.

2. The evaporated fuel processing device as in claim 1, further comprising:

a communication passage connected to the canister, and configured to communicate open air and the vent passage via the canister, wherein the first pump is disposed on the vent passage, and the third pressure value indicates a pressure of the air detected by the detector in a case where the canister retains no evaporated fuel.

3. The evaporated fuel processing device as in claim 1, further comprising:

a communication passage configured to communicate open air and the vent passage; and a switching valve disposed on the vent passage, and connected to the communication passage, wherein the first pump is disposed on the vent passage on an intake passage side relative to the switching valve, the switching valve is configured to switch between a first switching state and a second switching state, the first switching state being a state in which the first pump and the canister communicate with each other via the vent passage, and communication between the first pump and the communication passage is cut off on the vent passage, and the second switching state being a state in which the first pump and the communication passage communicate with each other via vent passage, and communication between the first pump and the canister is cut off on the vent passage, the first pressure value indicates a pressure of the mixed gas detected by the detector in the first switching state, and the third pressure value indicates a pressure of the air detected by the detector in the second switching state.

* * * * *